US007500345B2

(12) United States Patent
Kish

(10) Patent No.: US 7,500,345 B2
(45) **Date of Patent: *Mar. 10, 2009**

(54) MANDREL FOR A TUBULAR STRANDER

(75) Inventor: James Christopher Kish, Akron, OH (US)

(73) Assignee: The Goodyear Tire & Rubber Company, Akron, OH (US)

( * ) Notice: Subject to any disclaimer, the term of this patent is extended or adjusted under 35 U.S.C. 154(b) by 253 days.

This patent is subject to a terminal disclaimer.

(21) Appl. No.: 11/593,816

(22) Filed: Nov. 7, 2006

(65) Prior Publication Data

US 2008/0105327 A1 May 8, 2008

(51) Int. Cl.
*D01H 13/04* (2006.01)

(52) U.S. Cl. ..... 57/138; 57/314; 87/34

(58) Field of Classification Search ..... 57/138, 57/314; 87/34, 35

See application file for complete search history.

(56) References Cited

U.S. PATENT DOCUMENTS 313,905 A * 3/1885 Winans ..... 87/31
1,855,491 A * 4/1932 Schultz ..... 57/62
1,864,162 A * 6/1932 Zettek ..... 57/138
2,724,944 A * 11/1955 Carleton et al. ..... 57/311
3,492,803 A * 2/1970 Cannon et al. ..... 57/59
3,872,659 A * 3/1975 Campbell et al. ..... 57/33
4,976,812 A * 12/1990 McConnell et al. ..... 156/148
5,032,199 A * 7/1991 Landry et al. ..... 156/149
5,150,566 A * 9/1992 Stenmans ..... 57/58.83
6,314,856 B1 * 11/2001 Keith et al. ..... 87/9
6,526,859 B1 * 3/2003 Ozawa et al. ..... 87/35
2008/0104827 A1 * 5/2008 Kish ..... 29/605

* cited by examiner

*Primary Examiner*—Shaun R Hurley
(74) *Attorney, Agent, or Firm*—Richard B. O'Planick

(57) ABSTRACT

A mandrel for use in a strander assembly includes a mandrel body having a forward radiused end and an axial cable core receiving passageway extending from a rearward to a forward end of the mandrel body. A cable core is routed through the mandrel body and one or more strands are positioned to converge on the mandrel radiused end. The strands engage the mandrel radiused end at a common approach angle and follow the radius of the mandrel forward end to intersect the cable core. Rotation of the strands relative to the cable core wraps the strands about the cable core, resulting in a finished wound cable construction.

20 Claims, 5 Drawing Sheets

MANDREL FOR A TUBULAR STRANDER

FIELD OF THE INNVENTION

The invention relates generally to a mandrel for use on a tubular strander and, more particularly, a mandrel for use on a tubular strander used in the creation of a helically wound conductor.

BACKGROUND OF THE INVENTION

There are commercial applications in which a wound conductor is used as an electrical conductor or antenna. Such a conductor includes a central core having multiple wires twisted around the core in an axial direction. Such constructions are typically formed by a tubular strander that twists multiple wires together to create a wound finished conductor.

Conventional tubular stranders axially feed a core strand along a tubular feed core path. Multiple wire components are fed radially inward along respective feed paths to intersect the core strand. A rotation is initiated in the multiple wire components as they intersect the core. A helically twisted multi-strand conductor results.

While working well, conventionally available stranders are ill-equipped to make certain wire constructions where the core strand is weak in bending rigidity and where the twist geometry of the resulting wound conductor must be carefully controlled in order to insure proper wound conductor performance characteristics. Existing stranders have difficulty in maintaining the core strand and multiple wire components in the desired configuration within objective specifications. Moreover, wires brought radially inward to a core strand by means of conventional stranders lose are generally uncontrolled and may crossover each other during the twisting operation. The wound conductor that results may be non-uniform and may exhibit performance anomalies. Commercially available stranders, therefore, lack the means for maintaining a proper spatial relationship between radial wires and a core strand as the radial wires are fed into an intersecting relationship with the core strand. Improper spatial relation between the feed wires and the core strand will generally result in a faulty twist geometry.

A need accordingly exists for a tubular strander that can maintain an optimal spatial relationship between radially fed wire conductors and an axial core strand while the conductors are rotated into a wound conductor construction. Such a tubular strander should allow for careful control of the approach angle between the radial wire conductors and the conductor core and be capable of maintaining a desired pitch of finished product.

SUMMARY OF THE INVENTION

According to one aspect of the invention, a mandrel for use on a strander assembly includes a mandrel body having a forward radiused end and an axial cable core receiving passageway extending from a rearward to a forward end of the mandrel body. The radiused end of the mandrel body may be hemispherical. A cable core is routed through the mandrel body and one or more strands are positioned to converge on the mandrel radiused end. The strands engage the mandrel radiused end at a common approach angle and follow the radius of the mandrel forward end to intersect the cable core. Rotation of the strands relative to the cable core wraps the strands about the cable core, resulting in a finished wound cable construction.

Pursuant to another aspect of the invention, a plurality of strands converges on the mandrel radiused end at a common approach angle, tangentially intersecting respective locations of the mandrel radiused end.

BRIEF DESCRIPTION OF THE DRAWINGS

The invention will be described by way of example and with reference to the accompanying drawings in which.

DETAILED DESCRIPTION OF THE INVENTION

Figure 1:
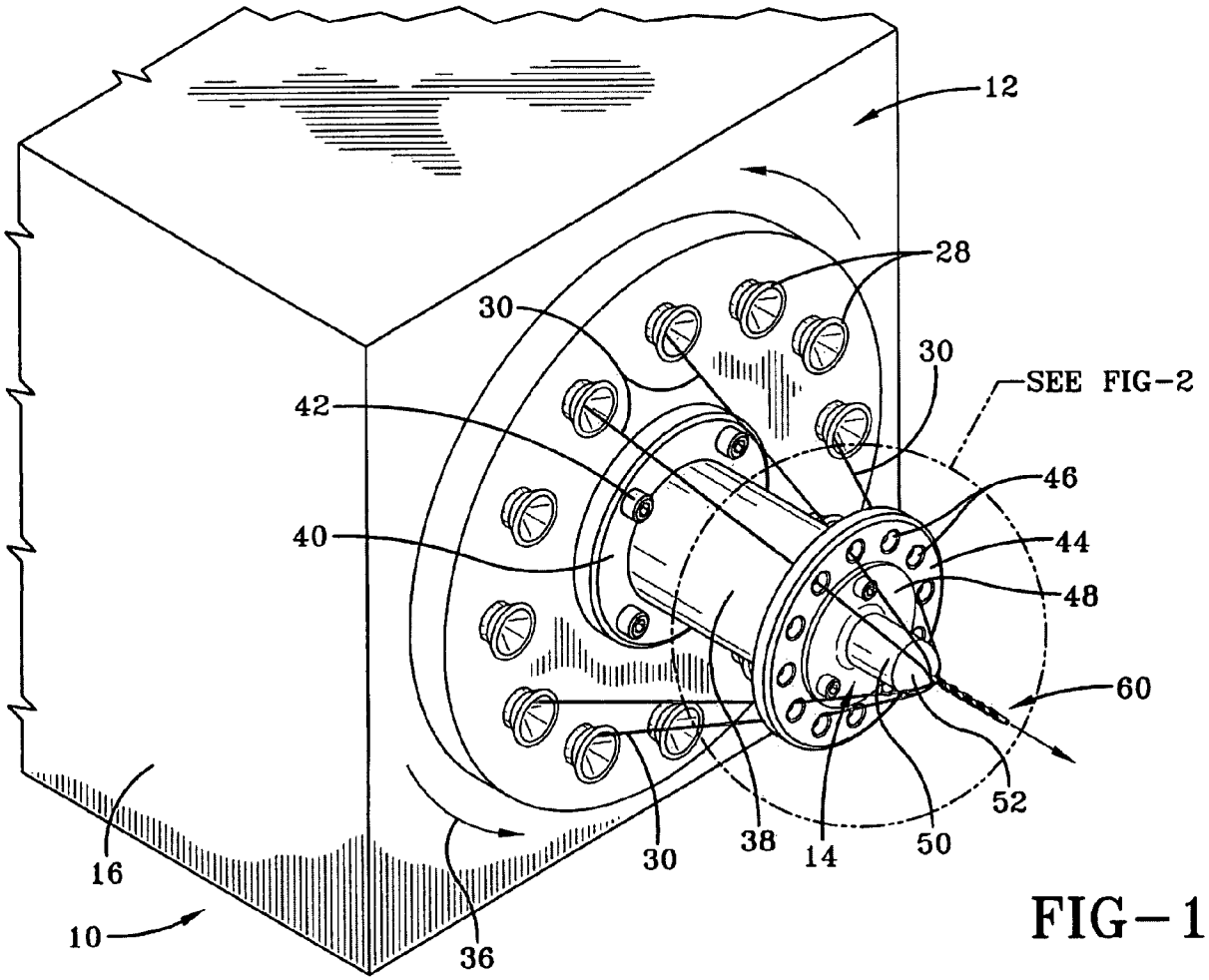
FIG. 1 is a front perspective view of a cable strander apparatus having a mandrel at the forward end.
Figure 2:
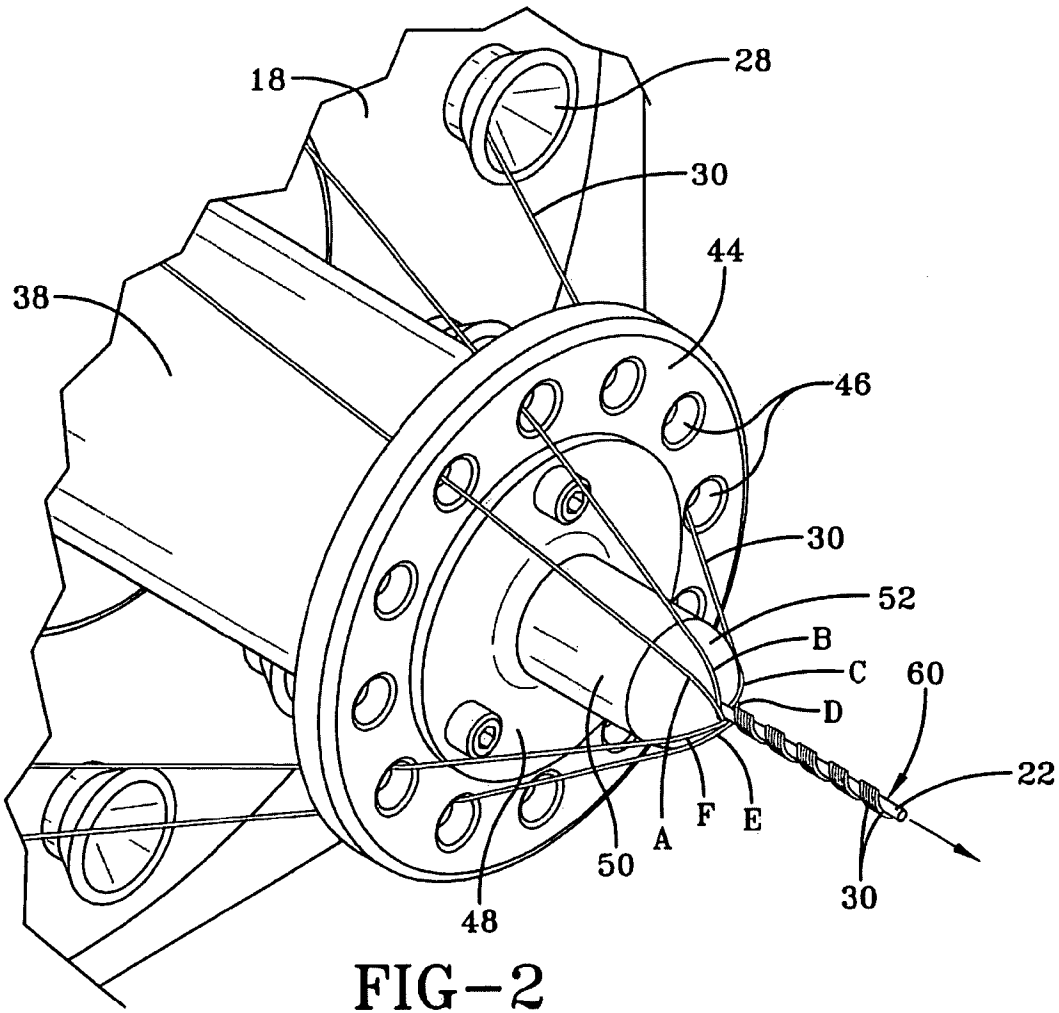
FIG. 2 is an enlarged front perspective view of the mandrel.
Figure 3:
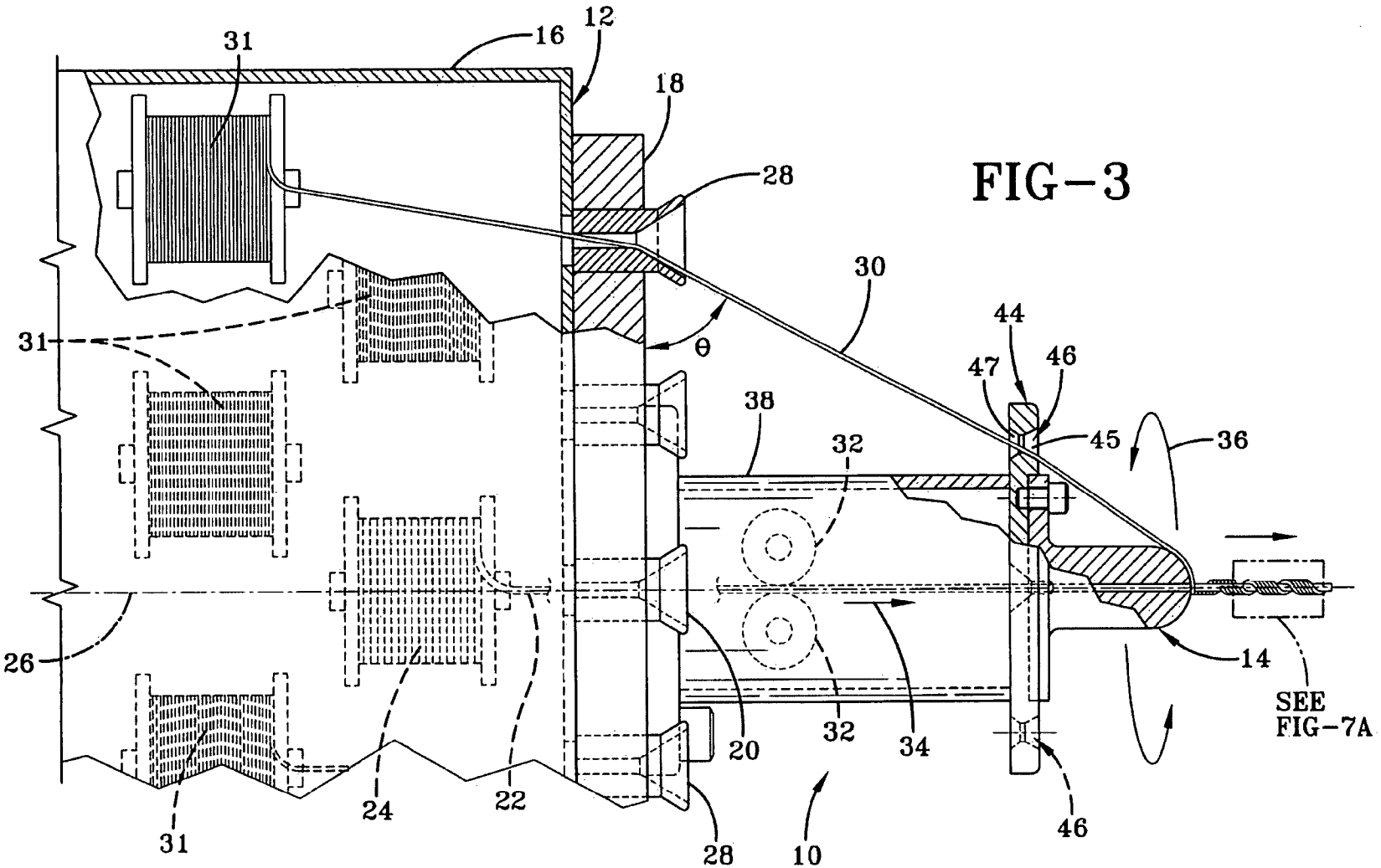
FIG. 3 is a longitudinal section view through a cable strander and mandrel.

With initial reference to FIGS. 1, 2, and 3, a station for forming a wound cable is shown generally at 10. The subject mandrel 14 is mounted forward in assembly 10 and is intended for use in conjunction with a tubular strander 12 housed within enclosure 16. The strander 12 includes a rotary plate 18 rotationally mounted to a forward face of the enclosure 16. A centrally disposed cable core outlet 20 extends through the plate 18 on a longitudinal axis 26 of the enclosure 16. A cable core 22 is fed along the axis 26 from a spool 24. For electrical cable construction, core 22 will be formed from a non-conductive material or composite.

An array of circumferentially disposed, spaced apart through bores or outlets 28 extend through the rotary plate 18. Each outlet 28 is generally frustro-conical in cross section at a forward end and communicates at a rearward end with the interior of enclosure 16. Multiple secondary strands 30 are routed from spools 31 within enclosure 16 through the outlets 28 as shown. The spools 31 are spaced apart so that each secondary strand 30 aligns generally with a respective outlet 28. The spools 31 feed each secondary strand 30 into its respective outlet 28 under tension as will be explained.

The cable core 22 and secondary strands 30 are pulled along the longitudinal axis 26 in an axial direction designated by numeral 34. The plate 18 is rotated in a controlled fashion in direction 36 relative to enclosure 16 by a conventional drive mechanism (not shown). The rotation of plate 18 causes co-extensive rotation of the secondary strands 30 extending through plate 18 in the direction 36. Fixedly attached to the forward side of enclosure 16 is a cylindrical projection 38. Projection 38 has a rearward annular flange 40 that affixes to the enclosure 16 by means of mounting bolts 42. At a forward end of the projection 38 is a peripheral annular flange 44. A circumferential array of through-bores 46 are disposed through the annular flange, the location of each bore 46 generally aligning with a corresponding respective bore 28 in the rotary plate 18. Each bore 46 is profiled in longitudinal section to provide frustro-conical leading 45 and trailing 47 portions that funnel a respective secondary strand 30 through the flange 44.

Figure 5:
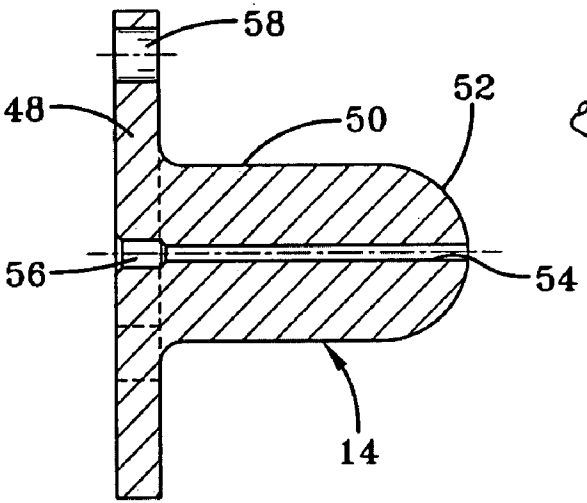
FIG. 5 is a longitudinal section view through a mandrel.
Figure 4:
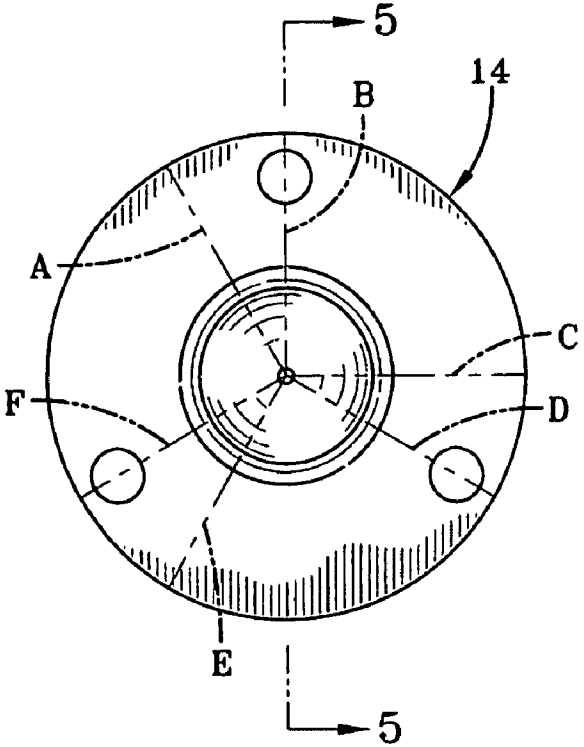
FIG. 4 is a front plan view of the mandrel of FIG. 3.

With reference to FIGS. 4 and 5, the mandrel 14 is formed of a suitably rigid material such as steel. Mandrel 14 includes a rearward annular flange 48, an elongate cylindrical body 50, and a radiused forward end 52. An axial passageway 54 having an enlarged lead-in rearward entry 56 is provided extending through the mandrel 14 from a rearward end to a forward end. Mounting apertures 58 extend through the flange 48 and provide means for fixed attachment of the mandrel 14 to the rotational plate 18. The forward radiused end 52 of mandrel 14 is preferably smooth and hemispherical in configuration. The end 52 has a radiused outward surface that curves continuously forward to an axially disposed forward opening of the passageway 54.

Figure 6:
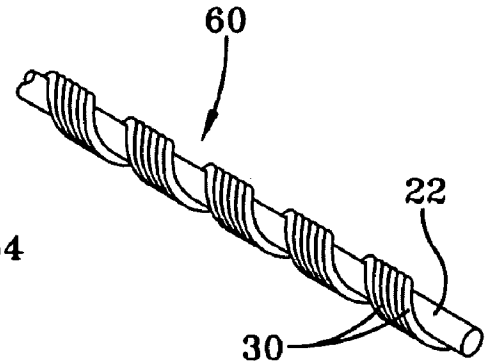
FIG. 6 is an enlarged perspective view of a wound cable segment.

Passageway 54 of the mandrel 14 is dimensioned in section to closely admit the cable core component 22 of the finished cable 60 as will be appreciated from FIG. 6. The wound cable 60 is configured having an axial cable core component 22 that has an effectively round shape and a helically wound bundle of secondary strands 30 wrapped around the core 22. Controlled spacing of the strands 30 relative to each adjacent strand and to the core 22 is important for the cable 60 to electrically function for its intended purpose. Cable 60 may be useful in its construction as an antenna for transmission and reception of radio frequency signals, for example.

From FIGS. 1, 2, and 3, operation of the mandrel 14 in conjunction with the strander 12 will be explained. The cable core component 22 is pulled from the reel 24 along an axial centerline by a conventional means which is downstream of the claimed invention. The component 22 projects through the outlet 20, between rollers 34, along the axis of the cylindrical projection 38, and into the mandrel 14. Within the mandrel passage, the cable core 22 extends axially forward to exit from a forward end of the mandrel 14. Secondary strands 30 of preferred number are fed from the reels 31 through respective outlets 28 within rotational plate 18. Upon exiting the plate 18, the secondary strands 30 are routed along respective convergent paths toward and through respective guide passages 46 of the mandrel flange 44. The reels 31 are located so that the secondary strand 30 fed therefrom will be generally aligned with its associated passageway 28 in plate 18 and its associate passageway 46 of mandrel flange 44.

Each strand 30 tangentially intersects a respective region A, B, C, D, E, or F, of the forward radiused portion 52 of the mandrel 14. Regions A, B, C, D, and E are spaced about the circumferential periphery of the mandrel end 52 so that the strands 30 will not interfere and become entangled with each other during the winding operation. Each strand 30, upon intersecting the mandrel end 52, follows the radius of curvature of the mandrel end 52 to the forward outlet of mandrel passageway 54 and the cable core 22 exiting therefrom. The multiple secondary strands 30 thus converge upon respective, separated regions of the mandrel end 52 and thereupon follow respective, separated paths along the curvature of mandrel end 52 to converge and meet at the cable core 22.

The strands 30 are wound around the cable core 22 by the rotation of rotary plate 18 as the cable core 22 is axially advanced. The strands 30 follow an optimized approach angle θ (FIG. 3) between the rotational plate 18 and the mandrel end 52 of approximately 45 degrees. This approach angle is equal for all of the strands 30. The spacing of intersection regions A, B, C, D, and E with the maintenance of a common approach angle θ for each strand 30 prevents crossover of the strands 30. That is, intersection of the outer secondary strands 30 with each other is prevented.

From the foregoing, it will be appreciated that the mandrel 14 works in conjunction with the strander apparatus 12 to create a wound cable construction of uniform twist and configuration. The mandrel may be fitted at the forward end of the strander and does not interfere with other components. The radiused forward end of the mandrel acts to separate the strands 30 and to keep their approach paths at an optimum, equal approach angle. The mandrel forward radiused end allows the strands 30 to follow the radius surface to meet at the cable core.

Figure 7A:
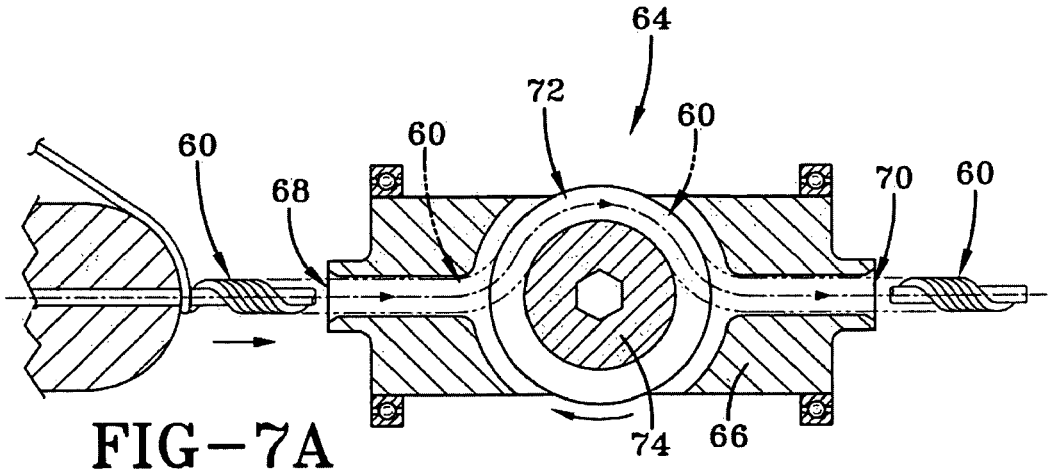
FIG. 7A is a longitudinal section view through an overtwister device used in conjunction with the cable strander apparatus.

With reference to FIGS. 3 and 7A, the subject strander apparatus may be used in conjunction with an overtwister device 64 situated downstream from the strander operation. The overtwister device 64 is intended to eliminate residual twist in the cable 60. Residual twist forces in cable 60 are the result of twisting the secondary, spring-like secondary strands 30 about the cable core 22. Such forces may tend to unwind or further wind the cable after the winding operation is complete. Thus, removing the residual forces in the cable 60 is important to create a well-behaved cable suitable for deployment as a finished product. The overtwister device 64 has a housing 66 through which a passageway 72 extends, from a passageway inlet 68 to a passageway outlet 70. A rotational pulley 74, driven by conventional means, is situated within the housing 66 and the cable 60 within passageway 72 is routed over the pulley 74 and out of the outlet 70. In passing over the pulley 74, an overtwist is imparted into the cable. Once the cable 60 passes out of the pulley, the overtwisted cable relaxes, removing any residual forces within the cable that could cause a change in the cable twist geometry. It is through the overtwisting and relaxing operation on the cable by the overtwist device 64 that residual forces within the cable from the winding operation are removed.

Figure 7B:
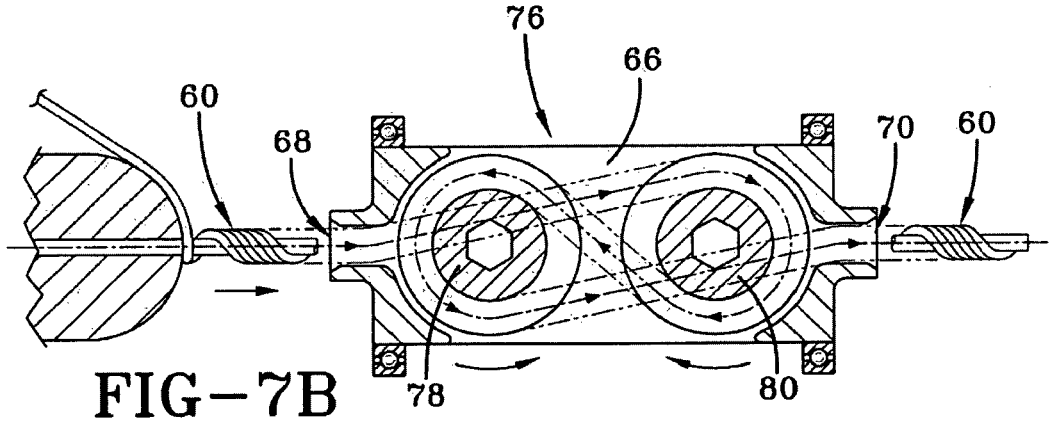
FIG. 7B is a longitudinal section view through a first alternative overtwister device.
Figure 7C:
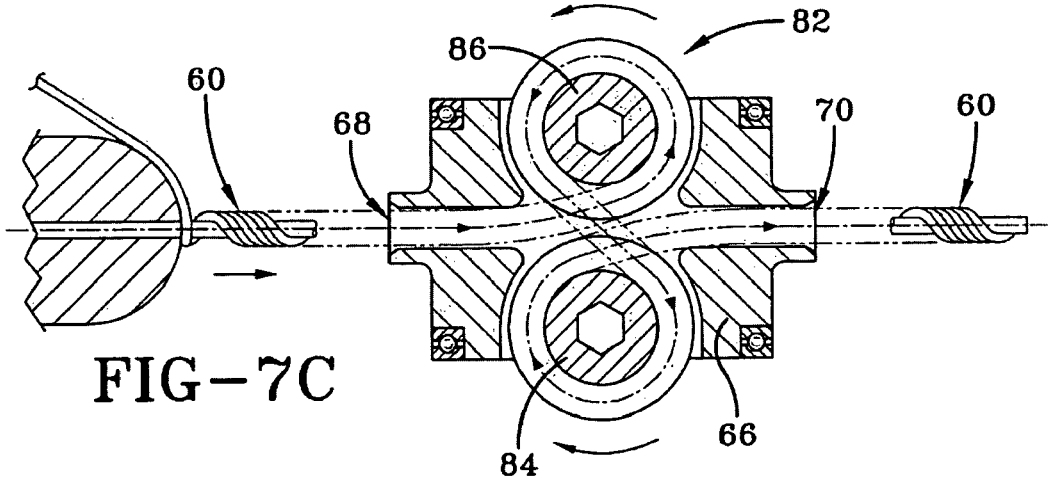
FIG. 7C is a longitudinal section view through a second alternative overtwister device.

FIG. 7B shows an alternative embodiment for an overtwister device 76 employing a series of pulleys 78, 80. The cable 60 may be routed over and around the pulleys 78, 80. Rotation of the pulleys 78, 80 by a conventional drive means will overtwist the cable 60. Once the cable 60 exits the second pulley 80, residual forces within the cable will dissipate. FIG. 7C shows a second alternative embodiment of an overtwister device 82 employing a vertically arranged pair of pulleys 84, 86. The cable 60 is routed over the pulleys 84, 86 in a figure eight path. Rotation of the pulleys 84, 86, as with the other overtwister devices, places the cable 60 in an overtwisted state. Once the cable 60 exits the device 82 residual forces within the cable 60 will be eliminated as the cable relaxes. As a result, the cable 60 will not wind or unwind and may be handled in a relaxed state.

Variations in the present invention are possible in light of the description of it provided herein. While certain representative embodiments and details have been shown for the purpose of illustrating the subject invention, it will be apparent to those skilled in this art that various changes and modifications can be made therein without departing from the scope of the subject invention. It is, therefore, to be understood that changes can be made in the particular embodiments described which will be within the full intended scope of the invention as defined by the following appended claims.

What is claimed is:

1. A mandrel for use on a strander assembly for winding at least one secondary strand about a primary cable core, comprising:

a mandrel body having a forward radiused end for operably engaging and directing the secondary strand against the radiussed end to an axial cable core exit opening extending from within the mandrel body through the mandrel body forward radiused end; and an axial cable core receiving passageway extending through the mandrel body from a rearward to the forward end of the mandrel body.

2. A mandrel according to claim 1, wherein the radiused end of the mandrel body is substantially smooth.

3. A mandrel according to claim 2, wherein the radiused end of the mandrel body is substantially hemispherical.

4. A mandrel according to claim 3, wherein the axial passageway at the forward end of the mandrel body is dimensioned to axially guide a cable core therethrough.

5. A mandrel according to claim 1, wherein the mandrel body forward end is radiused such that tangential lines tangent to the radiused end diverge in a rearward direction at a common approach angle.

6. A mandrel according to claim 5, wherein the radiused end of the mandrel body is substantially hemispherical.

7. A mandrel according to claim 5, wherein the tangential lines diverge a distance beyond an outer peripheral boundary of the rearward end of the mandrel body.

8. A strander assembly comprising:

a pulling mechanism for axially advancing a cable core and secondary strands;

a guide mechanism for axially directing at least one secondary strand toward the cable core at an approach angle;

means for rotating the at least one secondary strand about the cable core;

a mandrel body disposed at a forward end of the strander assembly, the mandrel body having a forward radiused end for operably engaging and guiding the at least one secondary strand to a cable core exit opening extending from within the mandrel body through the radiused end of the mandrel body; and an axial passageway extending from a rearward to the forward end of the mandrel body dimensioned to axially receive the cable core therethrough.

9. A strander assembly according to claim 8, wherein the at least one secondary strand intersects the cable core at the forward end of the mandrel body.

10. A strander assembly according to claim 9, wherein the radiused end of the mandrel body is substantially smooth.

11. A strander assembly according to claim 9, wherein the radiused end of the mandrel body is substantially hemispherical.

12. A strander assembly according to claim 8, wherein the at least one secondary strand tangentially intersects the mandrel body forward end at the approach angle.

13. A strander assembly according to claim 12, wherein the radiused end of the mandrel body is substantially hemispherical.

14. A strander assembly according to claim 8, wherein the at least one secondary strand diverges in a rearward direction from the mandrel body axial passageway.

15. A strander assembly according to claim 8, wherein comprising a plurality of secondary strands converging toward the cable core at respective approach angles;

the guide mechanism axially directing the plurality of secondary strands toward the cable core at said respective approach angles;

the rotary means rotating the plurality of secondary strands about the cable core; and the plurality of secondary strands intersecting the cable core at the forward end of the mandrel body.

16. A strander assembly according to claim 15, wherein the radiused end of the mandrel body is substantially smooth.

17. A strander assembly according to claim 15, wherein the radiused end of the mandrel body is substantially hemispherical.

18. A strander assembly according to claim 15, wherein the plurality of secondary strands tangentially intersect the mandrel body forward end at respective locations about the periphery of the mandrel body forward end.

19. A strander assembly according to claim 18, wherein the plurality of secondary strands intersect the mandrel body forward end at a substantially identical approach angle.

20. A strander assembly according to claim 18, wherein the secondary strands follow the radius of curvature of the mandrel body to the forward mandrel end to intersect the cable core.

* * * * *